US006517360B1

(12) United States Patent
Cohen

(10) Patent No.: US 6,517,360 B1
(45) Date of Patent: Feb. 11, 2003

(54) HIGH SPEED PRESSURE MOUNT CONNECTOR

(75) Inventor: Thomas S. Cohen, New Boston, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 09/878,549

(22) Filed: Jun. 11, 2001

Related U.S. Application Data

(62) Division of application No. 09/498,252, filed on Feb. 3, 2000.

(51) Int. Cl.[7] ..... H01R 13/648
(52) U.S. Cl. ..... 439/65; 439/608
(58) Field of Search ..... 439/608, 108, 439/571, 61, 65, 75

(56) References Cited

U.S. PATENT DOCUMENTS

| | | | | |
|---|---|---|---|---|
| 4,632,476 A | | 12/1986 | Schell | |
| 4,806,107 A | | 2/1989 | Arnold et al. | 439/79 |
| 4,846,727 A | | 7/1989 | Glover et al. | 439/608 |
| 4,975,084 A | | 12/1990 | Fedder et al. | 439/608 |
| 5,066,236 A | | 11/1991 | Broeksteeg | 439/79 |
| 5,141,453 A | * | 8/1992 | Fusselman et al. | 439/608 |
| 5,292,256 A | | 3/1994 | Brunker et al. | 439/108 |
| 5,429,520 A | | 7/1995 | Morlion et al. | 439/108 |
| 5,429,521 A | | 7/1995 | Morlion et al. | 439/108 |
| 5,433,617 A | | 7/1995 | Morlion et al. | 439/108 |
| 5,433,618 A | | 7/1995 | Morlion et al. | 439/108 |
| 5,484,310 A | | 1/1996 | McNamara et al. | 439/608 |
| 5,496,183 A | | 3/1996 | Soes et al. | 439/79 |
| 5,639,263 A | * | 6/1997 | Zell et al. | 439/608 |
| 5,795,191 A | * | 8/1998 | Preputnick et al. | 439/608 |
| 5,860,816 A | | 1/1999 | Provencher et al. | 439/79 |
| 5,980,321 A | * | 11/1999 | Cohen et al. | 439/608 |
| 5,993,259 A | | 11/1999 | Stokoe et al. | 439/608 |

FOREIGN PATENT DOCUMENTS

| | | | |
|---|---|---|---|
| EP | 0752739 A1 | 1/1997 | H01R/23/68 |

* cited by examiner

*Primary Examiner*—Renee Luebke
(74) *Attorney, Agent, or Firm*—Teradyne Legal Dept.

(57) ABSTRACT

A high speed, high density electrical connector for use with printed circuit boards is described. The connector is manufactured with wafer assemblies that are supported by a stiffener. Each wafer includes two pieces; a first piece supports both signal and ground conductors and a second piece supports signal conductors. The disclosed embodiments are principally configured for carrying differential signals, though other configurations are discussed. For differential signals, the signal conductors are arranged in pairs. The two pieces are attached together such that the signal pairs are formed with the broadside of, the conductors disposed adjacent. The connector attaches to at least one circuit board using pressure mounted contacts.

19 Claims, 8 Drawing Sheets

HIGH SPEED PRESSURE MOUNT CONNECTOR

RELATED APPLICATIONS

This application is a divisional of Ser. No. 09/498,252, filed Feb. 3, 2000, entitled High Speed Pressure Mount Connector by Thomas S. Cohen.

BACKGROUND OF THE INVENTION

Electrical connectors are used in many electronic systems. It is generally easier and more cost effective to manufacture a system on several printed circuit boards that are then joined together with electrical connectors. A traditional arrangement for joining several printed circuit boards is to have one printed circuit board serve as a backplane. Other printed circuit boards, called daughter boards, are connected through the backplane.

A traditional backplane is a printed circuit board with many connectors. Conducting traces in the printed circuit board connect to signal pins in the connectors so signals may be routed between the connectors. Daughter boards also contain connectors that are plugged into the connectors on the backplane. In this way, signals are routed among the daughter boards through the backplane. The daughter cards often plug into the backplane a. a right angle. The connectors used for these applications contain a right angle bend and are often called "right angle connectors."

Connectors are also used in other configurations for interconnecting printed circuit boards, and even for connecting cables to printed circuit boards. Sometimes, one or more small printed circuit boards are connected to another larger printed circuit board. The larger printed circuit board is called a "mother board" and the printed circuit boards plugged into it are called daughter boards. Also, boards of the same size are sometimes aligned in parallel. Connectors used in these applications are sometimes called "stacking connectors" or "mezzanine connectors."

Regardless of the exact application, electrical connector designs have generally needed to mirror trends in the electronics industry. Electronic systems generally have gotten smaller and faster. They also handle much more data than systems built just a few years ago. These trends mean that electrical connectors must carry more and faster data signals in a smaller space without degrading the signal.

Connectors can be made to carry more signals in less space by placing the signal contacts in the connector closer together. Such connectors are called "high density connectors." The difficulty with placing signal contacts closer together is that there is electromagnetic coupling between the signal contacts. As the signal contacts are placed closer together, the electromagnetic coupling increases. Electromagnetic coupling also increases as the speed of the signals increase.

In a conductor, electromagnetic coupling is indicated by measuring the "cross talk" of the connector. Cross talk is generally measured by placing a signal on one or more signal contacts and measuring the amount of signal coupled to another signal contact. The choice of which signal contacts are used for the cross talk measurement as well as the connections to the other signal contacts will influence the numerical value of the cross talk measurement. However, any reliable measure of cross talk should show that the cross talk increases as the speed of the signals increases and also as the signal contacts are placed closer together.

A traditional method of reducing cross talk is to ground signal pins within the field of the signal pins. The disadvantage of this approach is that it reduces the effective signal density of the connector.

To make both a high speed and high density connector, connector designers have inserted shield members between signal contacts. The shields reduce the electromagnetic coupling between signal contacts, thus countering the effect of closer spacing or higher frequency signals. Shielding, if appropriately configured, can also control the impedance of the signal paths through the connector, which can also improve the integrity of signals carried by the connector.

An early use of shielding is shown in Japanese patent disclosure 49-6543 by Fujitsu, Ltd. dated Feb. 15, 1974. U.S. Pat. Nos. 4,632,476 and 4,806,107, both assigned to AT&T Bell Laboratories, show connector designs in which shields are used between columns of signal contacts. These patents describe connectors in which the shields run parallel to the signal contacts through both the daughter board and the backplane connectors. Cantilevered beams are used to make electrical contact between the shield and the backplane connectors. U.S. Pat. Nos. 5,433,617; 5,429,521; 5,429,520 and 5,433,618, all assigned to Framatome Connectors International, show a similar arrangement. The electrical connection between the backplane and shield is, however, made with a spring type contact.

Other connectors have the shield plate within only the daughter card connector. Examples of such connector designs can be found in U.S. Pat. Nos. 4,846,727, 4,975,084, 5,496,183 and 5,066,236, all assigned to AMP, Inc. Another connector with shields only within the daughter board connector is shown in U.S. Pat. No. 5,484,310, assigned to Teradyne, Inc.

In patent application Ser. No. 09/156,227, assigned to Teradyne, Inc. and which is hereby incorporated by reference, a circuit board connector is shown. The connector is formed from two identical halves. Each half includes an insulative housing, a ground insert and a column of signal contacts. The two halves are mounted to opposite sides of a first printed circuit board. The plurality of signal contacts extend from a first surface of the housing and are attached to the first circuit board. The signal contacts extend through the insulative housing, extending from a second surface of the housing, and are bent to form spring contacts. The connector may then be mounted to a second circuit board by pressing the spring contacts into signal contact pads on the second circuit board, thus completing signal paths between the first and second circuit boards.

A modular approach to connector systems was introduced by Teradyne Connection Systems, of Nashua, New Hampshire. In a connector system called HD+®, multiple modules or columns of signal contacts are arranged on a metal stiffener. Typically, 15 to 20 such columns are provided in each module. A more flexible configuration results from the modularity of the connector such that connectors "customized" for a particular application do not require specialized tooling or machinery to create. In addition, many tolerance issues that occur in larger non-modular connectors may be avoided.

A more recent development in such modular connectors was introduced by Teradyne, Inc. and is shown in U.S. Pat. Nos. 5,980,321 and 5,993,259 which are hereby incorporated by reference. Teradyne, Inc., assignee of the above-identified patents, sells a commercial embodiment under the trade name VHDM™.

The patents show a two piece connector. A daughter card portion of the connector includes a plurality of modules held on a metal stiffener. Here, each module is assembled from two wafers, a ground wafer and a signal wafer. The backplane connector, or pin header, includes columns of signal pins with a plurality of backplane shields located between adjacent columns of signal pins.

Yet another variation of a modular connector is disclosed in U.S. patent application Ser. No. 09/199,126 which is hereby incorporated by reference. Teradyne Inc., assignee of the patent application, sells a commercial embodiment of the connector under the trade name VHDM—HSD. The application shows a connector similar to the VHDM™ connector, a modular connector held together on a metal stiffener, each module being assembled from two wafers. The wafers shown in the patent application, however, have signal contacts arranged in pairs. These contact pairs are configured to provide a differential signal. Signal contacts that comprise a pair are spaced closer to each other than either contact is to an adjacent signal contact that is a member of a different signal pair.

SUMMARY OF THE INVENTION

As described in the background, higher speed and higher density connectors are required to keep pace with the trends in the electronic systems industry. Constraints imposed by the geometries of backplanes designed for certain applications however, reduce the options available for possible connector solutions.

For example, thick, large backplanes make some surface mount connectors impractical as the number-of layers in the board hinders raising the board to a temperature necessary to solder the leads to the board. Press fit connectors require larger vias. As via diameters increase, the capacitance of the via also increases thus making an impedance match between the connector and the characteristic impedance of a transmission line on the backplane more difficult. In addition, larger vias consume more real estate on the backplane which, in the alternative, could be used to route wider signal traces which can be used to control conductive losses.

One connector solution described in the following disclosure provides a high speed, high density pressure mounted connector. The connector is comprised of a plurality of wafers suspended from a member which provides an organized presentation of the wafers. In an illustrated embodiment, the member is shown as a metal stiffener.

In a preferred embodiment, the wafers are comprised of two halves, a first half including both signal and ground conductors and a second including only signal conductors. When attached, the two halves form a single wafer in which signal conductors are arranged in pairs which, in a preferred embodiment, are configured to provide a differential signal. A ground conductor is provided proximate to the differential signal pair. The conductor tails are configured at a first end as pressure mount contacts to make contact with signal and ground launches located on a surface of a backplane. With such an arrangement, the signal and ground launches on the backplane may be used with smaller diameter vias.

BRIEF DESCRIPTION OF THE DRAWINGS

The foregoing and other objects, features and advantages of the invention will be apparent from the following more particular description of a High speed, pressure mount connector, as illustrated in the accompanying drawings in which like reference characters refer to the same parts throughout the different views. For clarity and ease of description, the drawings are not necessarily to scale, emphasis instead being placed upon illustrating the principles of the invention.

DETAILED DESCRIPTION OF THE INVENTION

Figure 1:
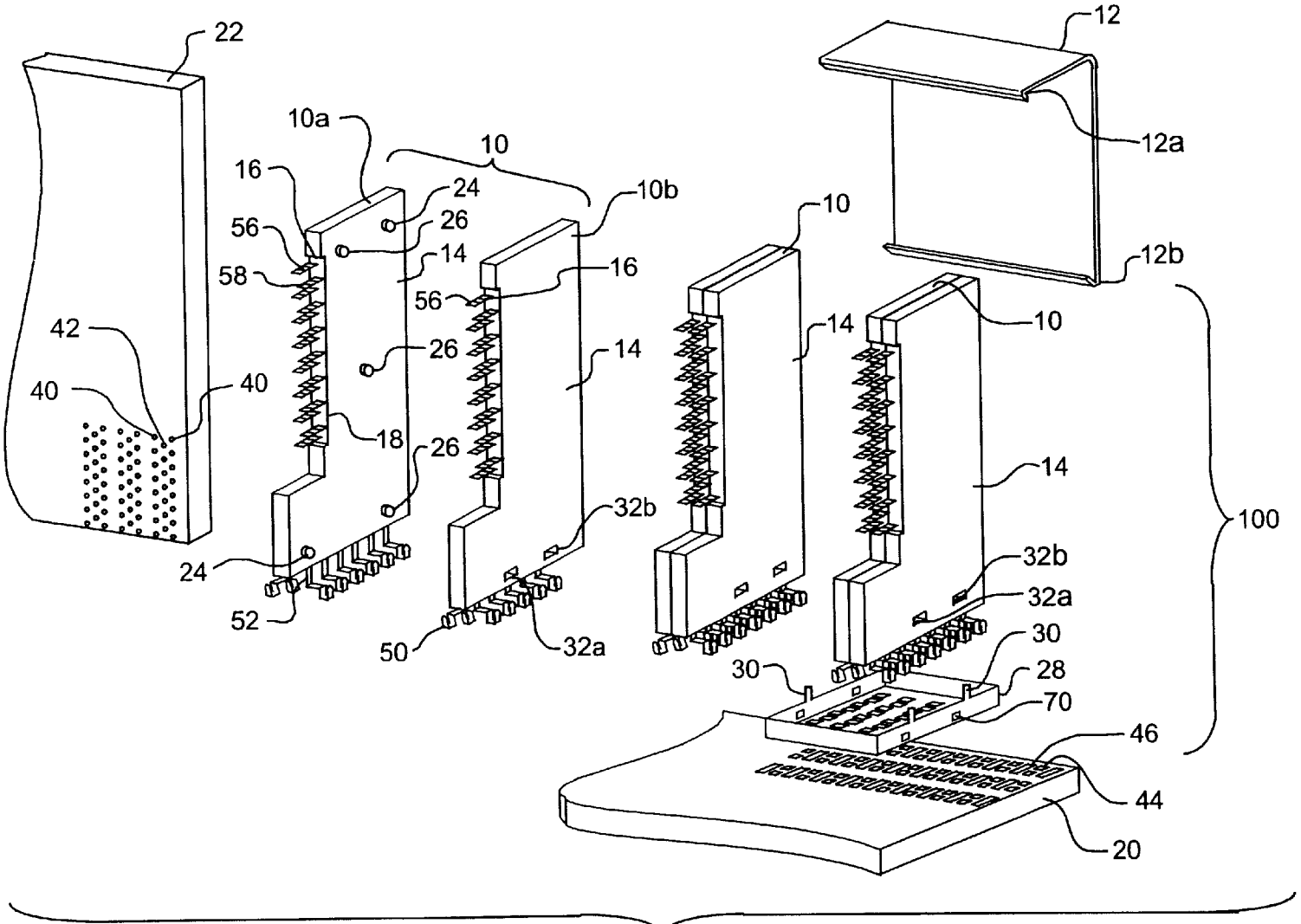
FIG. 1 is an exploded view of a connector manufactured in accordance with one embodiment of the invention.

Referring now to FIG. 1, an exploded view of a connector 100 manufactured in accordance with one embodiment of the invention is shown. The connector 100 is configured to transfer a plurality of signals between a first circuit board 20 and a second circuit board 22. In a preferred embodiment, the connector 100 is pressure mounted at a first edge of the connector 100 to the first circuit board 20, which is a traditional backplane. At a second edge, the connector is attached to the second circuit board 22, which is a traditional daughter card.

The connector 100 is shown to include a plurality of wafers 10 supported by a metal stiffener 12. The stiffener 12 is shown as a solid piece of shaped metal. Preferably, the stiffener is formed from extruded aluminum. To hold the wafers 10 in place, the stiffener 12 is placed against the wafers 10 and a tool is used roll the edges 12*a*, 12*b* of the stiffener 12 against the wafers 10 to both retain and align the wafers 10.

In an alternate embodiment (not shown), the stiffener 12 is stamped stainless steel and includes features to hold the wafer 10 in the required position without rotation. For example, a repeating series of apertures are formed in the length of the stiffener 12. To affix the wafers 10 to a stiffener of this type, the corresponding wafers 10 for such an embodiment include features, typically taking the form of tabs and or hubs, located on two adjacent edges of the wafers 10 that insert into the apertures in the stiffener 12. An example of such an embodiment is shown in U.S. Pat. No. 5,980,321.

In a preferred embodiment, each of the wafers 10 is comprised of two halves 10*a*, 10*b*. The two halves 10*a*, 10*b* include a housing 14 that is formed from an insulative material. Suitable insulative materials are a plastic such as a liquid crystal polymer (LCP), a polyphenyline sulfide (PPS), a high temperature nylon or some other suitable insulative material that is temperature resistant and may be successfully molded in dimensions that include thin walls.

The two halves 10*a*, 10*b* are mechanically connected. In one embodiment, each of the wafers will include snap fit features for attachment. An alternative to snap fit attachment is an interference fit attachment. Alternatively, pins or rivets can be passed through the wafers to secure them together. Adhesives might also be used for mechanically securing the wafers together. Alternatively, bonding of plastic of the wafers could be used to hold the wafers together.

In the illustrated embodiment, a series of posts 24 and holes 26 are included on an inside face of each wafer half

10*a*, 10*b* to align and hold the two pieces together. The pattern of posts 24 and holes 26 are inverted from one wafer half 10*a* to the other wafer half 10*b* such that when pressed together, opposing features mate with each other.

For example, here, the first wafer half 10*a* is shown to include a post 24 on the upper right and lower left corner of the inside face of the wafer half 10*a*. A diagonal line including three holes 26 is provided beginning at the top left of the wafer half 10*a* and ending on the bottom right of the wafer half 10*a*. The corresponding pattern (not shown) included on the inside face of the second wafer half 10*b* provides holes 26 in the mating locations of the second wafer half 10*b* where posts 24 are included on the first wafer half 10*a*. Correspondingly, posts 24 are located on the second wafer half 10*b* in the mating locations where holes 26 are included on the first wafer half 10*a*. When the first and second wafer halves 10*a*, 10*b* are mated, the posts 24 lodge within the holes 26 thus attaching the first wafer half 10*a* to the second wafer half 10*b*.

An alternate method of attaching the two halves 10*a*, 10*b* of the wafers will be discussed in conjunction with FIG. 2A.

As described above, the housing 14 is formed from an insulative material that is, in the preferred embodiment, insert molded around a plurality of conductive elements 16, 18.

The conductive elements 16, 18 disposed within the insulative housing 14 of the first half 10*a* of the wafer 10 are a plurality of signal contacts 16 and a plurality of ground contacts 18. The signal contacts 16 extend from both a first and a second edge of the wafer 10 and terminate in a plurality of signal contact tails 50, 56. Likewise, the ground contacts 18 also extend from the first and second edges of the wafer 10 and terminate in a plurality of ground contact tails 52, 58.

Disposed within the insulative housing 14 of the second half of the wafer 10*b* are a plurality of signal contacts 16. The signal contacts 16 extend from a first and second edge of the second half 10*b* of the wafer 10 and terminate in a plurality of signal contact tails 50, 56.

The signal 50 and ground contact tails 52 extending from the first edge of the wafers 10 are adapted to make contact with signal launches 44 and ground launches 46, respectively, located on a surface of the first circuit board 20. The signal 56 and ground contact tails 58 that extend from the second edge of the wafers 10 are adapted to make contact with signal launches 40 and ground launches 42, respectively, located on a surface of the second circuit board 22.

Also shown in FIG. 1 and included in connector 100 is a lead protector 28. The lead protector 28 is formed from an insulative material such as a plastic. Here, the lead protector 28 snaps onto the bottom of the plurality of :wafers 10 to protect the signal contact tails 50 extending from a first edge of the wafers 10 from being damaged during use or other handling.

Here, the lead protector 28 includes four walls and a recessed bottom. Located on an upper surface edge of each of two opposing walls of the lead protector 28 is a pair of hooks 30 formed from the insulative material. These hooks 30 are inserted into apertures 32*a*, 32*b* disposed at a lower edge of a wafer 10. As may be seen in FIG. 1 these apertures 32*a*, 32*b* are located on each wafer 10 such that a single mold may be used for each of the wafers 10 during the molding process.

Located on the recessed bottom of the lead protector 28 is a pattern of apertures 48 that duplicates the pattern formed by the signal 44 and ground 46 launches located on the surface of the first circuit board 20. The signal contact tails 50 and ground contact tails 52 make contact with the signal 44 and ground launches 46 on the first circuit board 20 through these apertures 48.

As described above, the signal contact tails 50 and ground contact tails 52 extending from the first edge of the wafers 10 are pressure mounted contacts. That is, the contact tails 50, 52 are formed to provide a spring contact between the connector 100 and the first circuit board 20. To provide a reliable electrical contact, a force is exerted on the daughter card to compress the pressure mounted contacts and apply a spring force between the contact tails 50, 52 and the ground 46 and signal launches 44 on the first circuit board 20.

In one embodiment, the connector 100 is mounted to the daughter card 22 and the backplane 20 is included in a card cage system. Typically, card cage systems have guide rails for daughter cards to ensure that they are appropriately aligned with connectors on the backplane. A typical daughter card used in a card cage assembly has locking levers to hold it in place. A locking lever arrangement can be used to generate the required force to press connector 100 against backplane 20.

In a preferred embodiment, jack screws (not shown) are threaded through an additional stiffener (not shown) which runs the length of the connector 100, above the stiffener 12. The jack screws run through holes (not shown) in the backplane 22 and into a steel beam (not shown) on the back side of the backplane which includes threaded holes. When tightened down, the jack screws press the additional stiffener into the connector 100 forcing the signal 50 and ground contact tails 52 to compress onto the signal 44 and ground launches 46 on the backplane 20. Jack screws can be adjusted to generate the required force independent of manufacturing tolerances on the printed circuit boards 20, 22.

Figure 2B:
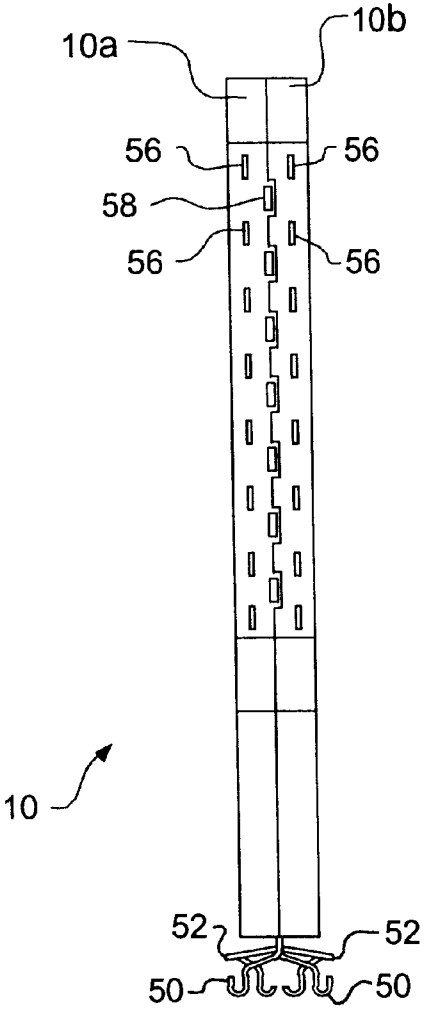
FIG. 2*b* is a planar view of the wafer of FIG. 2*a*.
Figure 2A:
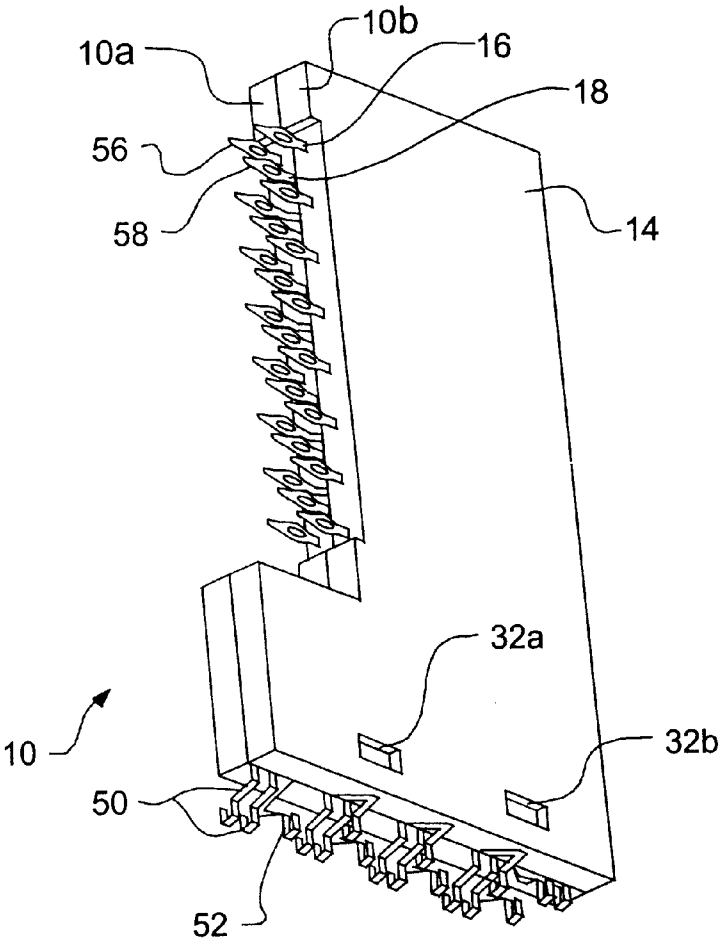
FIG. 2*a* is a perspective view of the wafer of FIG. 1.

Referring now to FIG. 2A, an assembled one of the wafers 10 of FIG. 1 is shown. The signal contact tails 56 are adapted for being press fit into the signal launches 40, which include holes, in the daughter card 22. Signal holes are plated through holes that connect to signal traces in the daughter card 22. Likewise, the ground contact tails 59 are adapted for being press fit into the ground launches 42, which include holes in the daughter card 22. Ground holes are plated through holes that connect to ground traces in the daughter card 22. Here, the signal contact tails 56 and the ground contact tails 58 are shown as press fit or "eye of the needle" contacts.

In an alternate embodiment, the signal and ground contact tails 56, 58 take the form of semi-intrusive surface mount (SISMNT) contacts. For SISMNT contacts, the backplane 20 is fitted with multi-dimensional holes. At the surface of the backplane 20, a hole of circumference $D_1$ is drilled for a depth that is less than the thickness of the backplane 20, typically just through the first few layers. From the back end of this first hole through to the backside of the backplane 20 a second hole is drilled of circumference $D_2$ where $D_2$. A short SISMNT contact is inserted into the first hole and soldered into place. A detailed description of SISMNT contacts is included in patent application Ser. No. 09/204,118, which is assigned to Teradyne, Inc. and is hereby incorporated by reference.

The signal 50 and ground contact tails 52 extending from the first edge of the wafer 10 are pressure mounted contacts. They are configured to provide a spring-like action when the connector 100 is pressed against the backplane 20 by compressing against the backplane signal and ground launches 44, 46. When the force is removed from the daughter card 22 and connector 100, the contact tails 50, 52 revert back to their uncompressed state.

In a further alternate embodiment, the signal and ground contact tails 56, 58 also take the form of pressure mounted contacts. Pressure mounted contacts which may be used in conjunction with the connector 100 are described in further detail with reference to FIG. 5.

FIG. 2B is a planar view of the front face of the wafer 10 of FIG. 2A. As described above with reference to FIG. 1, the wafer 10 is comprised of two halves 10*a*, 10*b*. Here, it may be noted that the signal contact tails 56 are arranged in pairs with a ground contact tail 58 being located below the pair of signal contact tails 56. In a preferred embodiment, the signal contact tails 56 are configured to provide a differential signal. A pair of conduction paths provides a differential signal where the voltage difference between the two paths represents the differential signal of the pair.

Also apparent from this view is a pattern of raised portions of insulative material formed over a face of the conductive element 18 in the first wafer half 10*a*. On the face of the opposing wafer half 16 is a mating plurality of indentations or grooves into which the raised portions lodge. These features combine to provide an-alternate embodiment for both an alignment and attachment means for the two wafer halves 10*a*, 10*b*.

Here, the pair of conductive elements 16 are configured side-by-side resulting in a broadside coupling of the pair. Broadside coupled differential pairs provide numerous advantages. A first advantage is that when the conductive elements 16 are routed side by side, the lengths of the conductive elements 16 are equal. By providing equal lengths signal skew may be avoided in which signals travelling through unequal length conductors arrive at a destination at different times due to the different length paths thus introducing a skew between the two signals.

A second benefit is that, because the signal paths are exposed to each other over a wider surface area, a stronger coupling between the differential signals results. Accordingly, the leads may be routed closer together thus allowing greater distance between signal pairs, effectively reducing cross talk.

A typical pitch or spacing between the signal pairs in the wafer 10 is within the range of 15 to 25 mils. The spacing between ground contact tails is in the range of 70 to 80 mils. In the illustrated embodiment, the signal pair pitch is approximately 20 mils while the ground contact tail pitch from one wafer to the next is approximately 72 mils.

Also apparent from this view of the wafer 10, is the configuration of the signal 50 and ground contact tails 52. Here, the signal contact tails are configured to travel from a center section of the wafer 10 out toward the edge of the wafer 10. An endpoint of the contact tail is radiused to provide a U-shaped bend out toward the edges of the wafer 10. The ground contact tails likewise travel from a center section of the wafer 10 however, they extend beyond the edges of the wafer 10 and are then return back in toward the center of the wafer 10. Like the endpoints of the signal contact tails 50, the ground contact tails 52 are similarly radiused to provide a U-shaped bend however, the ground contact tails are curved in toward the center of the wafer 10.

Figure 3:
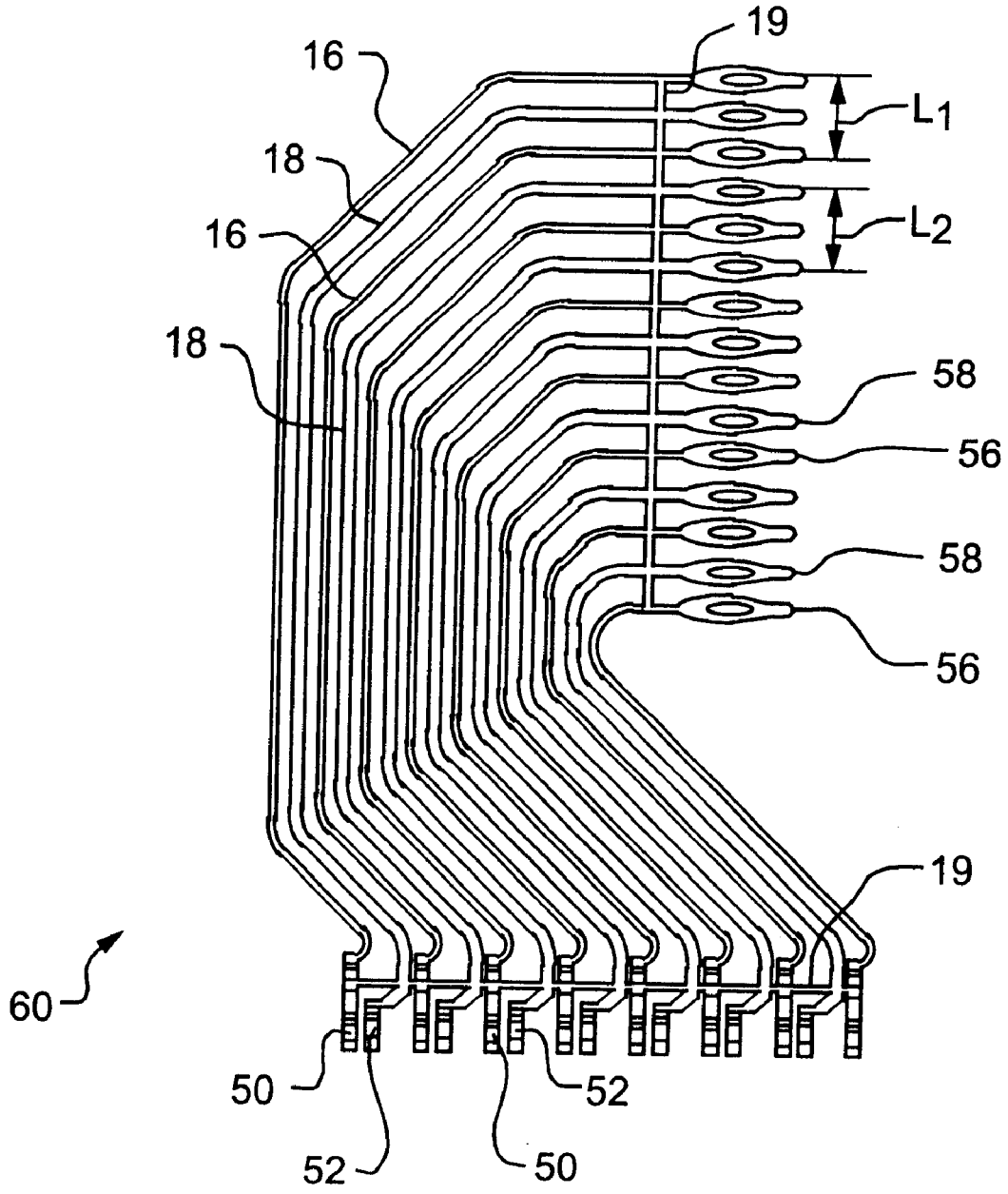
FIG. 3 is the signal and ground lead frame of the first half of the wafer of FIG. 1.

Referring now to FIG. 3, a signal and ground lead frame 60 of the first half of the wafer 10*a* of FIG. 1 is shown. The lead frame 60 is preferably stamped from a rolled copper alloy such as beryllium copper, which may range between 6.5 mils and 8 mils thick. Generally, many such lead frames are stamped in a roll. The lead frame of the first half of the wafer 10*a* includes both signal conductive elements 16 and ground conductive elements 18. Here, the signal 16 and ground 18 elements are shown to alternate. In a preferred embodiment, seven ground elements 18 are included and eight signal elements 16. The ground elements 18 are shown to be wider than the signal elements 16. In the illustrated embodiment, the ground elements 18 are 7 mils thick and 20 mils wide while the signal elements 16 are 7 mils thick and 10 mils wide.

FIG. 3 also shows tie bars 19 which connect the conductive elements 16, 18 together. The tie bars 19 are cut off after the wafers 10 are formed or, at another time when they are no longer needed for handling the ground and signal lead frames 60.

The spacing between the signal conductive elements 16 is of a distance $L_1$ and is constant throughout the length of the conductive elements 16. The spacing between the ground conductive elements 18 is of a distance $L_2$ and is likewise constant throughout the length of the conductive elements 18. The values for $L_1$ and $L_2$ are chosen to provide a differential pair density of approximately 50 pairs per inch.

Figure 4:
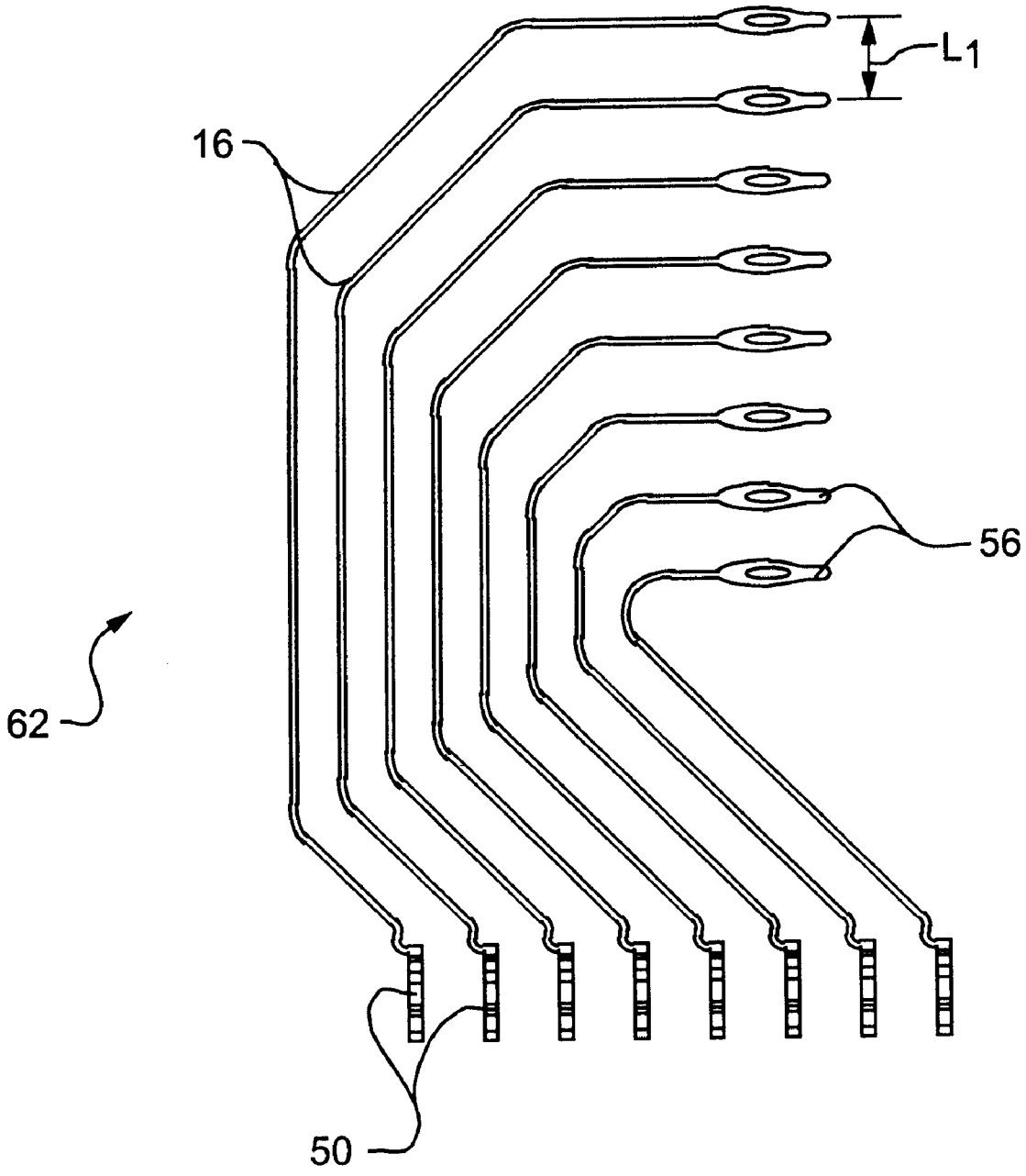
FIG. 4 is the signal lead frame of the second half of the wafer of FIG. 1.

Referring now FIG. 4, the signal lead frame 62 of the second half of the wafer 10*b* of FIG. 1 is shown to include only signal conductive elements. Like the signal and ground lead frame 60 of FIG. 3, the signal lead frame 62 is formed from a rolled copper alloy such as beryllium copper, typically, which may range between 6.5 mils and 8 mils thick. In the illustrated embodiment, the lead frame is 7 mils thick. The spacing between the signal conductive elements 16 is of a distance $L_1$, the same spacing between the signal conductive elements 16 in the signal and ground lead frame 60. As in the signal and ground lead frame 60, the spacing between the signal conductive elements 16 of the signal lead frame 62 is constant throughout the length of the signal conductive element 16.

The signal and ground lead frame 60 of FIG. 3 and the signal lead frame 62 of FIG. 4 each show the pressure mounted contacts 50, 52 after they have been manipulated into their final shape. The actual configuration of these signal 50 and ground contact tails 52 are described more fully in conjunction with FIG. 5.

Figure 5:
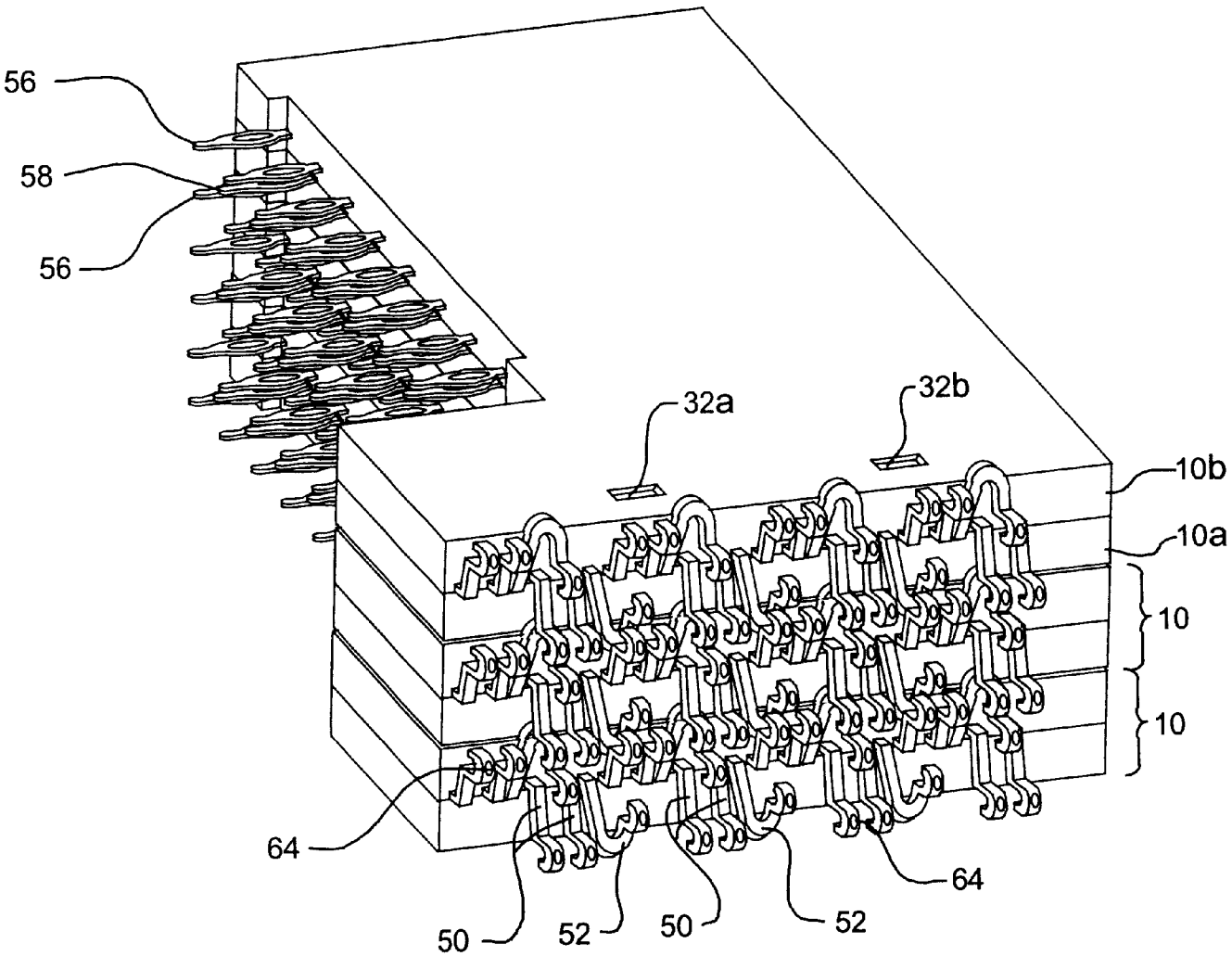
FIG. 5 is a perspective view of the pressure mounted contacts of the wafer of FIG. 1.

Referring now to FIG. 5, a view from the bottom of the wafers 10 shows a pattern formed by the pressure mounted contacts 50, 52. The signal contact tails 50 extend from the wafer 10 and are bent at an angle such that the length of the contact tail 50 proceeds in a gradual slope away from the bottom surface of the wafer 10. At a second point along the length of the contact tail 50, a second bend is provided, thus finishing the signal contact tail 50 with a U-shaped termination. Referring back to FIG. 2B, a profile of the signal contact tail 50 may be seen to resemble a section of a metal hanger that includes the hook portion of the hanger and the shoulder portion of the hanger extending from the back of the hook. Each signal contact tail 50 is configured in a pair with the other member of the pair residing adjacent the first. Moreover, the pairs are bent in alternating directions such that a first pair extends to the left of center while a second pair extends to the right of center. By alternating the signal pairs from side to side in the wafer, less cross talk is experienced by the signal pairs. Moreover, a mechanical balance is achieved by alternating the point of contact from side to side thus balancing the torsional forces.

The path of the ground contact tails 52 is serpentine in nature. As the signal contact tails 50, the ground contact tails 52 extend out from the center of the wafer 10. A first bend is located such that the ground contact tail 52 gradually slopes away from the bottom surface of the wafer 10. At a location just beyond the edge of the wafer 10, the ground contact tail 52 curves back toward the center of the wafer 10. A second bend is placed in the ground contact tail 52 such that a U-shaped termination is place just to the left or right of the center of the wafer 10. A primary consideration for configuring the ground contact tail 52 in such a way is to keep the U-shaped terminations of the ground contact tail 52 and the signal contact tail 50 at a distance sufficient to prevent shorting when the connector 100 is pressed against the backplane 20. Again, as with the signal contact tails 50, the ground contact tails 52 are bent in alternating directions.

The series of bends located within the signal and ground contact tails 50, 52 provide the necessary spring action. In this way, the signal and ground contact tails 50, 52 are not deformed when pressed against the backplane 20 but rather compress and then return to their former shape when release from the backplane 20.

Also located on a surface of the U-shaped portions of the contact tails 50, 52 is an oval shaped impression 64. When the connector 100 is actuated and the contact tails 50, 52 are pressed against the backplane, the oval impressions 64 provide a small, defined surface area onto which the contact pressure of the connector 100 is focused. As a result a higher contact pressure is achieved by confining the contact forces to a smaller contact area.

Due to the physical nature of the contact tails 50, 52 it is beneficial to provide a means to protect the contact tails or leads as well as to restrict the range of motion of the contact tails 50, 52 30 they are not damaged during frequent attachments to the backplane 20.

Figure 6:
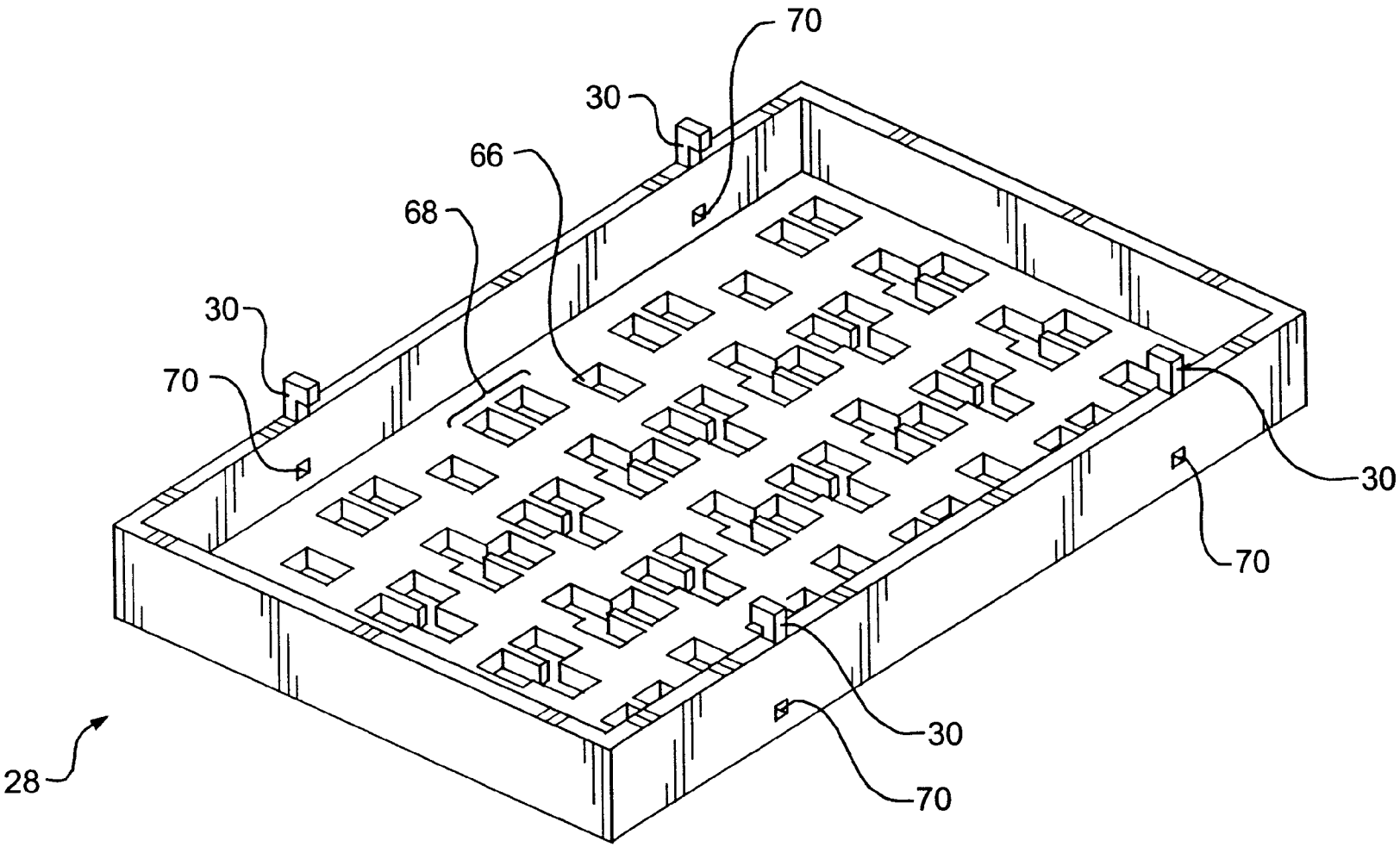
FIG. 6 is the lead protector of FIG. 1.

Referring now to FIG. 6, the lead or contact tail protector 28 of FIG. 1 is shown. Here, the aperture pattern 48 disposed on the floor of the lead protector 28 is shown to include an alternating pattern of a single rectangular shaped aperture 66 followed by a pair of rectangular shaped apertures 68. When snapped to the bottom of the wafers 10, each signal contact tail 50 is exposed through one of the pair of rectangular shaped apertures 68 and each ground contact tail 52 is exposed through one of the single rectangular shaped apertures 66.

Use of the lead protector 28 provides some level of protection for the signal 50 and contact tails 52 from damage due to a high level of use or from basic handling of the connector 100. In addition, the lead protector 28 limits the range of motion of the connector 100 during actuation. The floor and walls of the lead protector 28 define a limited range of motion through which the connector 100 is permitted to travel. Here, the lead protector is configured to receive eight wafers 10 however, other configurations to receive more or fewer wafers 10 may be provided.

Also evident in FIG. 6 are small holes 70 that appear on the walls of the lead protector 28 below each of the four hooks 30. These holes result during the molding process of the lead protector 28 and more specifically from the molding of the hooks 30.

Figure 7:
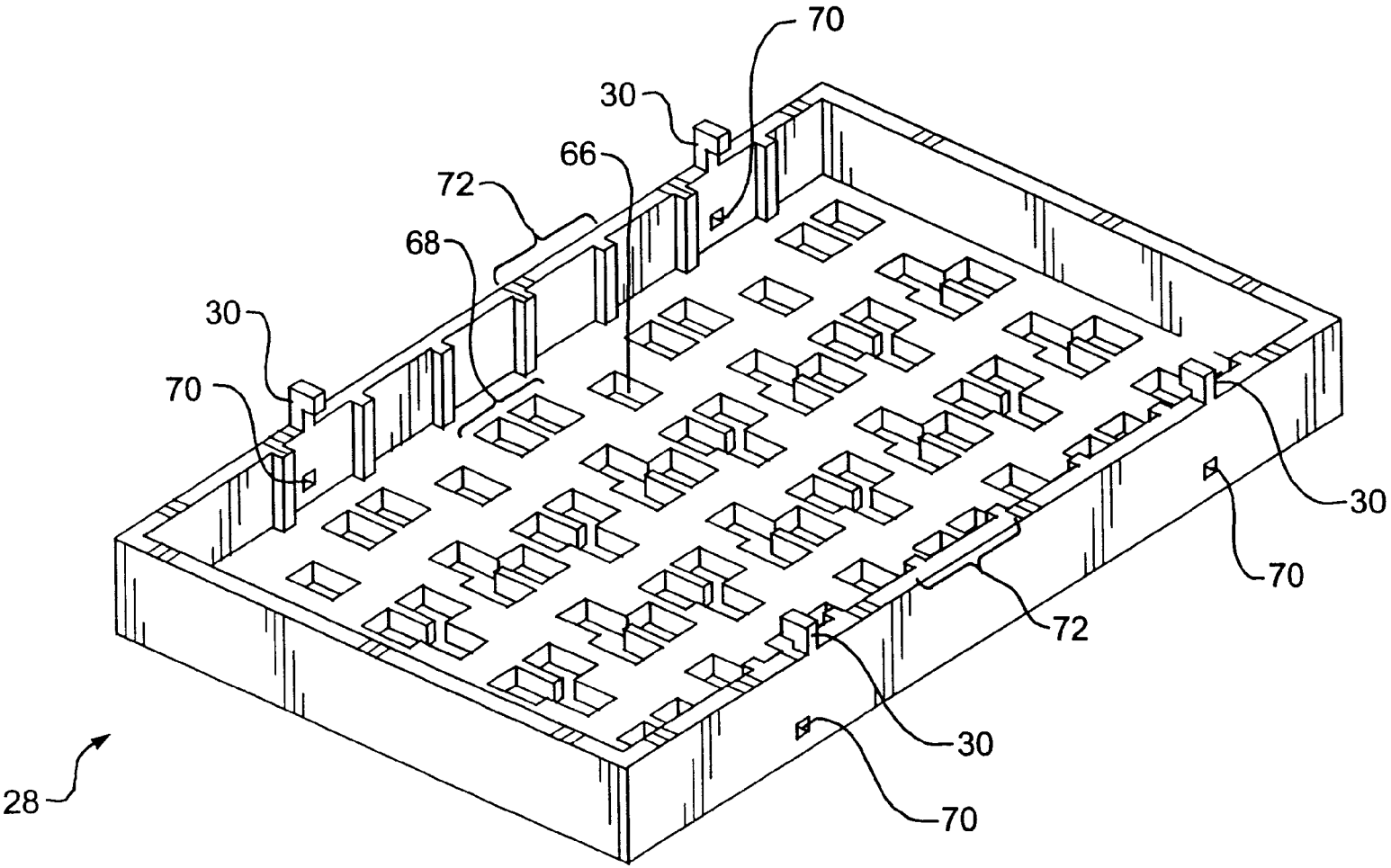
FIG. 7 is an alternate embodiment of the lead protector of FIG. 1.

Referring now to FIG. 7, an alternate embodiment of the lead protector of FIG. 6 is shown to include grooves or slots 72 into which a wafer 10 is inserted. These slots 72 provide an additional means by which the wafers 10 may be prevented from rotating.

Figure 8:
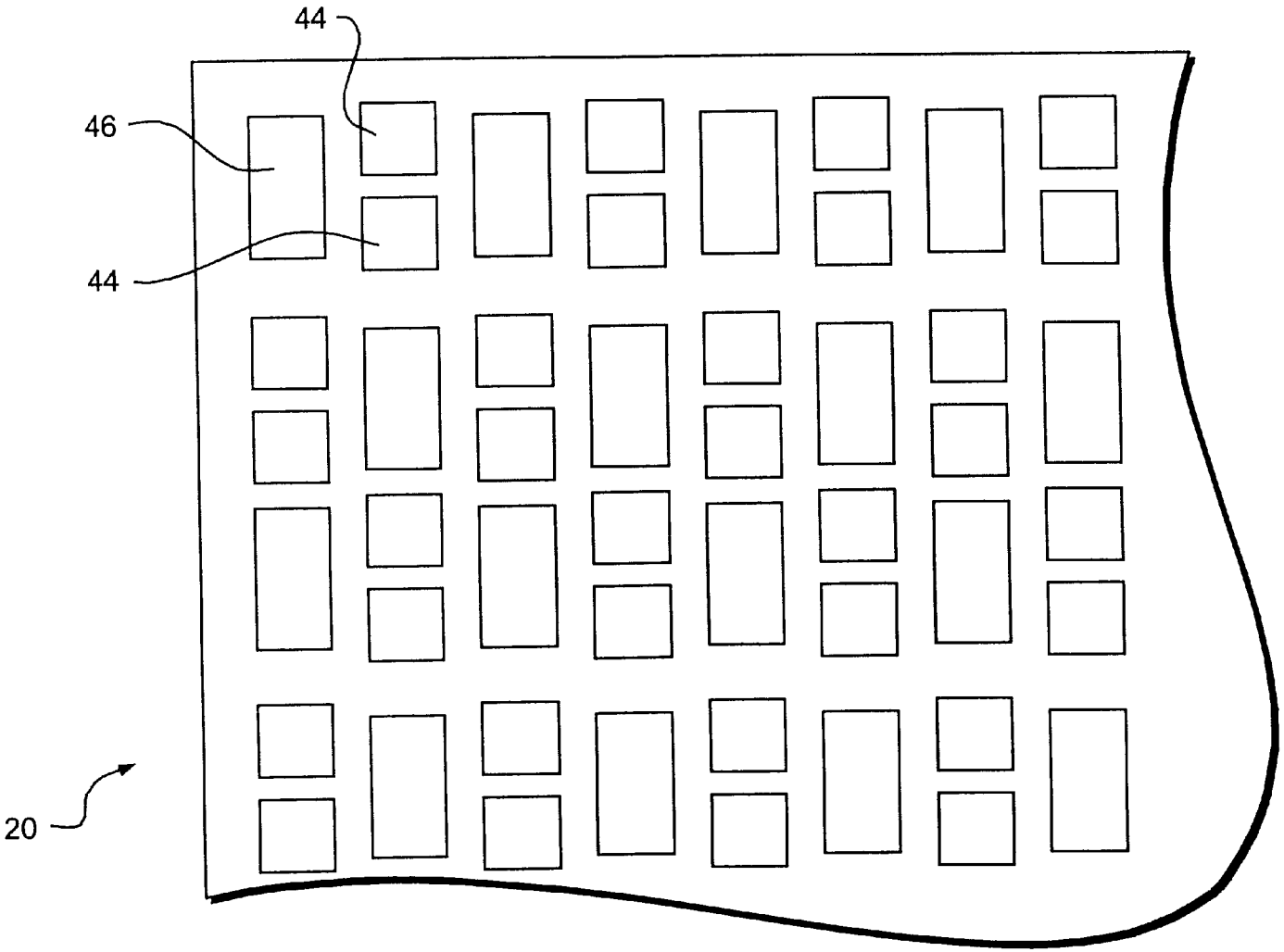
FIG. 8 is a planar view of a backplane footprint used in connection with the pressure mounted contacts of FIG. 5.

FIG. 8 is a planar view of a signal 44 and ground launch 46 backplane footprint used in connection with the pressure mounted contacts 50, 52 of FIG. 5. Here, only a portion of the backplane 20 is shown.

In a preferred embodiment, the launch pads 44, 46 are plated with a noble metal, preferably gold. Typically, the launch pads 44, 46 are first formed with nickel and then over plated with gold. The launch pads are arranged such that a surface length of a ground launch pad 46 is roughly equal to the length of two signal launch pads arranged end to end.

A basic pattern of two signal launch pads 44 to a single ground launch pad 46 is repeated across the required length of the backplane 20, alternating rows of the pattern reversing the design. That is, in a first row of signal 44 and ground launches 46 the ground launch pad 46 is presented to the left of the signal launch pad 44 pair. In the second row however, the ground launch pad is presented to the right of the signal launch pad 44 pair.

Having described one embodiment, numerous alternative embodiments or variations might be made. For example, a differential connector is described in that signal conductors are provided in pairs. Each pair is intended in a preferred embodiment to carry one differential signal. The connector could still be used to carry single ended signals. For instance, an insulative cap could be attached to the half of the connector that includes both signal and ground conductors, rather than the other half of the connector that includes additional signal conductors.

Also, the connector is described as a right angle daughter card mounted to a backplane application. The invention need not be so limited. Similar structures could be used for cable connectors, mezzanine connectors or connectors with other shapes.

Variations might also be made to the structure or construction of the insulative housing. While the preferred embodiment is described in conjunction with an insert molding process, the connector might be formed by first molding a housing and then inserting conductive members into the housing.

In addition, the connector has been described as providing a broadside coupled, differential signal. The connector may also be configured such that a single housing supports both conductors of the signal pair as well as the ground conductor. In such an embodiment, the lead frame would include a ground conductor disposed between each pair of signal conductors. In this manner, the pair could provide an edge coupled differential signal.

While this invention has been particularly shown and described with references to preferred embodiments thereof, it will be understood by those skilled in the art that various changes in form and details may be made therein without departing from the scope of the invention encompassed by the appended claims.

What is claimed is:

1. An electrical connector having a first mating face for mating to a first printed circuit board and a second mating face for mating to a second printed circuit board, the electrical connector comprising:

a) a plurality of subassemblies, each of the subassemblies having an insulative portion with a plurality of conductive members disposed therein, the insulative portion having a first edge and a second edge and each of the conductive members having a first end extending from the first edge of the insulative portion and a second end extending from the second edge of the insulative portion;

b) the first ends of the conductive members comprising pressure mount contacts for mating to the first printed circuit board and the second ends of the conductive members comprising contacts for mating to the second printed circuit board; and c) an insulative member attachable to the plurality of subassemblies adjacent the first ends of the conductive members, the insulative member having a surface with openings corresponding to the pressure mount contacts so that the pressure mount contacts are exposed on the first mating face.

2. The electrical connector of claim 1 additionally comprising a support member joining the plurality of subassemblies at a point away from the mating face.

3. The electrical connector of claim 1, wherein a first group of the conductive members of each of the subassemblies is adapted to be signal conductors and a second group of the conductive members of each of the subassemblies is adapted to be reference conductors, the pressure mount contacts of the signal conductors being grouped in pairs with a pressure mount contact of a reference conductor being disposed between adjacent pairs of signal conductor pressure mount contacts.

4. The electrical connector of claim 1 wherein the connector is a right angle connector.

5. The electrical connector of claim 1 wherein each subassembly is formed from a wafer of a first type and a second type, each wafer having an insulative portion with conductive members embedded therein.

6. The electrical connector of claim 5 wherein the wafers of each subassembly are joined.

7. The electrical connector of claim 5 wherein the conductive members are insert molded in the insulative portion.

8. The electrical connector of claim 5 wherein the first type wafer contains a first plurality of conductive members and the second type wafer has a first plurality of conductive members aligned with the conductive members in the first type wafer and a second plurality of conductive members, each disposed between adjacent conductive members in the first type wafer.

9. The electrical connector of claim 8 wherein the first plurality of conductive members are signal conductors and the second plurality of conductive members are reference conductors.

10. An electrical connector assembled from a plurality of subassemblies aligned side-by-side, each subassembly having a first type wafer and a second type wafer, each wafer having an insulative portion and a plurality of conductive members embedded therein, wherein the conductive members in the first type wafer have contact portions extending from the insulative portion in a first line and the conductive members of the second type wafer have contact portions extending from the insulative portion with the contract portions of a first portion of the conductive members of the second type wafer disposed in line parallel to the first line and the contact portions of a second portion of the conductive members in the second type wafer are disposed in a line parallel to the first line, with each of the contact portions of the second portion of conductive members being disposed between adjacent ones of the contact portions in the first line.

11. The electrical connector of claim 10 wherein the second portion of the conductive members are reference conductors.

12. The electrical connector of claim 10 wherein each wafer has a major surface and the first type wafers and the second type wafers are aligned with their major surfaces in parallel and the conductive members of the first type wafer are aligned with the first portion of the conductive members of the second type wafer.

13. The electrical connector of claim 10 wherein the contact portions of the first portion of the conductive members in the second type wafer and the contact portions of the first type wafer are grouped in pairs, with a contact portion of the second portion of conductive member in the second wafer between adjacent pairs.

14. The electrical connector of claim 10 wherein the conductive members are insert molded in the first type wafer and the second type wafer.

15. The electrical connector of claim 14 additionally comprising a support member connected to the plurality of subassemblies.

16. The electrical connector of claim 10 wherein the contact portions of the first type wafer and the second type wafer are pressure mount contacts.

17. The electrical connector of claim 16 wherein the contact portion of the second portion of conductive members are longer than the contact portion of the first portion of the conductive members.

18. The electrical connector of claim 16 wherein said contact portions of both the first type and second type wafer are pressure mount contacts disposed in a first plane and the conductive members of the first and second type wafers additionally comprise press fit contacts extending from the insulative portion, said press fit contacts disposed in a second plane at right angles to the first plane.

19. The electrical connector of claim 18 incorporated into a backplane assembly, additionally comprising a backplane having a plurality of conductive pads thereon and a daughter card having a plurality of holes therein, with the press fit contacts inserted in said holes, wherein the a portion of the conductive pads are reference potential pads and the contact portions of the second portion of the conductive members make a pressure contact to the reference potential pads.

* * * * *